US011017710B2

(12) United States Patent
Xue et al.

(10) Patent No.: US 11,017,710 B2
(45) Date of Patent: May 25, 2021

(54) DRIVING CIRCUIT, DRIVING METHOD AND DISPLAY APPARATUS

(71) Applicants: BOE Technology Group Co., Ltd., Beijing (CN); Beijing BOE Optoelectronics Technology Co., Ltd., Beijing (CN)

(72) Inventors: Zijiao Xue, Beijing (CN); Yan Li, Beijing (CN); Shuaishuai Xu, Beijing (CN); Lingyun Shi, Beijing (CN); Wei Sun, Beijing (CN); Guangquan Wang, Beijing (CN); Dong Chen, Beijing (CN); Xue Dong, Beijing (CN); Xiaochuan Chen, Beijing (CN); Shengji Yang, Beijing (CN)

(73) Assignees: BOE Technology Group Co., Ltd., Beijing (CN); Beijing BOE Optoelectronics Technology Co., Ltd., Beijing (CN)

( * ) Notice: Subject to any disclaimer, the term of this patent is extended or adjusted under 35 U.S.C. 154(b) by 543 days.

(21) Appl. No.: 15/751,405

(22) PCT Filed: Aug. 9, 2017

(86) PCT No.: PCT/CN2017/096525
§ 371 (c)(1),
(2) Date: Feb. 8, 2018

(87) PCT Pub. No.: WO2018/126680
PCT Pub. Date: Jul. 12, 2018

(65) Prior Publication Data

US 2020/0242997 A1 Jul. 30, 2020

(30) Foreign Application Priority Data

Jan. 3, 2017 (CN) ..... 201710001227.1

(51) Int. Cl.
*G09G 3/20* (2006.01)

(52) U.S. Cl.
CPC ... *G09G 3/2092* (2013.01); *G09G 2310/0202* (2013.01); *G09G 2310/0264* (2013.01); (Continued)

(58) Field of Classification Search
CPC ..... G09G 3/2092; G09G 2310/0202; G09G 2310/0264; G09G 2330/021; G09G 2340/0407
See application file for complete search history.

(56) References Cited

U.S. PATENT DOCUMENTS

2003/0214476 A1* 11/2003 Matsuda ..... G09G 3/3688 345/100
2004/0130520 A1 7/2004 Maeda et al.
(Continued)

FOREIGN PATENT DOCUMENTS

CN 1460982 A 12/2003
CN 1501706 A 6/2004
(Continued)

OTHER PUBLICATIONS

Nov. 9, 2017—(WO) International Search Report and Written Opinion Appn PCT/CN2017/096525 with English Tran.

*Primary Examiner* — Temesghen Ghebretinsae
*Assistant Examiner* — Sosina Abebe
(74) *Attorney, Agent, or Firm* — Banner & Witcoff, Ltd.

(57) ABSTRACT

A driving circuit, a driving method and a driving apparatus, wherein the driving circuit includes: a driving signal generation sub-circuit; a plurality of first signal lines, configured to receive the driving signal generated from the driving signal generation sub-circuit; a plurality of second signal lines, configured to output the driving signal to the plurality of pixels in the display panel; a switch sub-circuit, set (Continued)

between the plurality of first signal lines and the plurality of second signal lines, and configured to selectively connect a part of the plurality of second signal lines or the plurality of first signal lines and the plurality of second signal lines; and a control sub-circuit, configured to control turn-on or turn-off of the switch sub-circuit, so that the plurality of pixels of the display panel are driven in a first mode or in a second mode.

14 Claims, 8 Drawing Sheets

(52) U.S. Cl.
CPC ..... *G09G 2330/021* (2013.01); *G09G 2340/0407* (2013.01)

(56) References Cited

U.S. PATENT DOCUMENTS

| | | | | |
|---|---|---|---|---|
| 2008/0218500 | A1 | 9/2008 | Akai et al. | |
| 2010/0277463 | A1* | 11/2010 | Yen ..... | G09G 3/20 345/213 |
| 2016/0171938 | A1 | 6/2016 | Na et al. | |
| 2017/0178557 | A1 | 6/2017 | Li et al. | |

FOREIGN PATENT DOCUMENTS

| | | | |
|---|---|---|---|
| CN | 101261801 | A | 9/2008 |
| CN | 104978944 | A | 10/2015 |
| CN | 106531110 | A | 3/2017 |
| JP | 2005309304 | A | 11/2005 |

* cited by examiner

DRIVING CIRCUIT, DRIVING METHOD AND DISPLAY APPARATUS

CROSS-REFERENCE TO RELATED APPLICATION

The application is a U.S. National Phase Entry of International Application No. PCT/CN2017/096525 filed on Aug. 9, 2017, designating the United States of America and claiming priority to Chinese Patent Application No. 201710001227.1 filed on Jan. 3, 2017. The present application claims priority to and the benefit of the above-identified applications and the above-identified applications are incorporated by reference herein in their entirety.

TECHNICAL FIELD

The present disclosure relates to a driving circuit, a driving method and a display apparatus.

BACKGROUND

At present, a display apparatus having a high resolution has already been very widespread. When displaying is conducted at a high resolution, power consumption of the display apparatus would be very high. However, in many cases, when displaying is still conducted at a high resolution in the context of not requiring to display at a high resolution, unnecessary power consumption would occur, which would cause serious problem for an electronic device such as a mobile device.

For this reason, it is desired to provide a driving circuit, a driving method and a display apparatus, which is capable of switching between different resolutions to display according to different scenarios, so as to save power consumption.

SUMMARY

According to one embodiment of the present disclosure, there is provided a driving circuit, comprising: a driving signal generation sub-circuit, configured to generate a driving signal for driving a plurality of pixels in a display panel; a plurality of first signal lines, configured to receive the driving signal generated from the driving signal generation sub-circuit; a plurality of second signal lines, configured to output the driving signal to the plurality of pixels in the display panel; a switch sub-circuit, set between the plurality of first signal lines and the plurality of second signal lines, and configured to selectively connect a part of the plurality of second signal lines or the plurality of first signal lines and the plurality of second signal lines; and a control sub-circuit, configured to control turn-on or turn-off of the switch sub-circuit, so that the plurality of pixels of the display panel are driven in a first mode or in a second mode, wherein the display panel has a first resolution in the first mode, and the display panel has a second resolution in the second mode, and the second resolution is lower than the first resolution.

According to another embodiment of the present disclosure, there is provided a driving method applicable to the driving circuit as described above, the method comprising: controlling turn-on or turn-off of a switch sub-circuit, so that a plurality of pixels of a display panel are driven in a first mode or in a second mode, wherein the first mode has a first resolution, and the second mode has a second resolution, the second resolution is lower than the first resolution.

According to another embodiment of the present disclosure, there is provided a display apparatus, comprising: a display panel, including a plurality of pixels; and a driving signal generation sub-circuit, configured to generate a driving signal for driving a plurality of pixels in a display panel; a plurality of first signal lines, configured to receive the driving signal generated from the driving signal generation sub-circuit; a plurality of second signal lines, configured to output the driving signal to the plurality of pixels in the display panel; a switch sub-circuit, set between the plurality of first signal lines and the plurality of second signal lines and configured to selectively connected a part of the plurality of second signal lines or the plurality of first signal lines and the plurality of second signal lines; a control sub-circuit, configured to control turn-on or turn-off of the switch sub-circuit, so that the plurality of pixels of the display panel are driven in a first mode or in a second mode, wherein the display panel has a first resolution in the first mode, and the display panel has a second resolution in the second mode, the second resolution is lower than the first resolution.

Therefore, the driving circuit, the driving method and the display apparatus according to the embodiments of the present disclosure are capable of switching between different resolutions to display according to different scenarios, so that power consumption is saved.

BRIEF DESCRIPTION OF THE DRAWINGS

In order to describe technical solutions of embodiments of the present disclosure more clearly, figures of the embodiments will be introduced briefly below. Obviously, the figures described below just relate to some embodiments of the present invention, but not limitation to the present invention.

DETAILED DESCRIPTION

In order to make purposes, technical solutions and advantages of embodiments of the present disclosure more clear, technical solutions of the embodiments of the present disclosure will be described clearly and completely by combining with accompanying figures of the embodiments of the present disclosure. Obviously, the embodiments described below are just a part of embodiments of the present disclosure, but not all the embodiments. Based on the embodiments of the present disclosure described below, all the other embodiments obtained by those ordinary skilled in the art without paying any inventive labor belong to the scope sought for protection in the present disclosure.

A driving circuit, a driving method and a display apparatus according to the embodiments of the present disclosure will be described below in detail referring to the accompanying figures. The driving circuit according to embodiments of the present disclosure can be applicable to any display apparatus. Examples of such display apparatus may comprise a liquid crystal display, an OLED display, etc.

Figure 1:
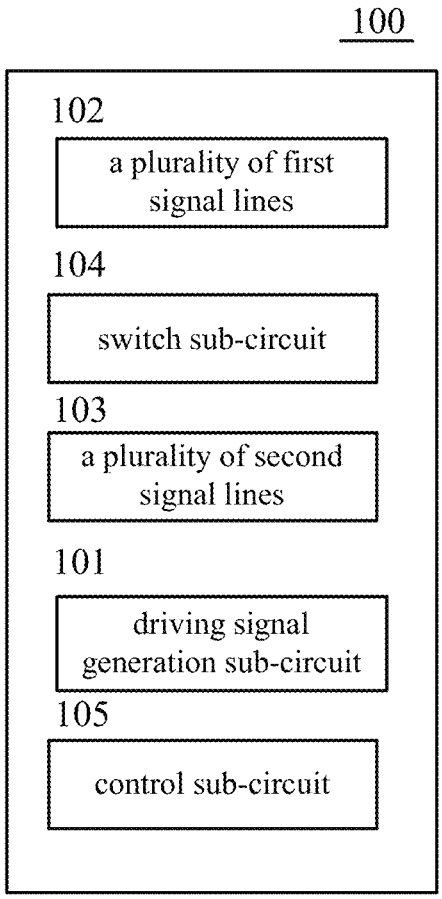
FIG. 1 is a configuration block diagram illustrating a driving circuit according to some embodiments of the present disclosure.

A driving circuit according to some embodiments of the present disclosure will be described below in detail by referring to FIGS. 1 and 2. FIG. 1 is a configuration block diagram illustrating the driving circuit according to some embodiments of the present disclosure.

As shown in FIG. 1, a driving circuit 100 according to some embodiments of the present disclosure comprises:

a driving signal generation sub-circuit 101, configured to generate a driving signal for driving a plurality of pixels in a display panel;

a plurality of first signal lines 102, configured to receive the driving signal generated from the driving signal generation sub-circuit 101;

a plurality of second signal lines 103, configured to output the driving signal to the plurality of pixels in the display panel;

a switch sub-circuit 104, set between the plurality of first signal lines and a plurality of second signal lines, and configured to selectively connected a part of the plurality of second signal lines or the plurality of first signal lines and the plurality of second signal lines;

a control sub-circuit 105, configured to control turn-on or turn-off of the switch sub-circuit 104, so that the plurality of pixels of the display panel are driven in a first mode or in a second mode, wherein the first mode has a first resolution, and the second mode has a second resolution mode, and the second resolution is lower than the first resolution.

Respective components of the driving circuit 100 will be described below in detail by referring to FIG. 2. FIG. 2 is a circuit diagram illustrating the driving circuit according to some embodiments of the present disclosure.

Figure 2:
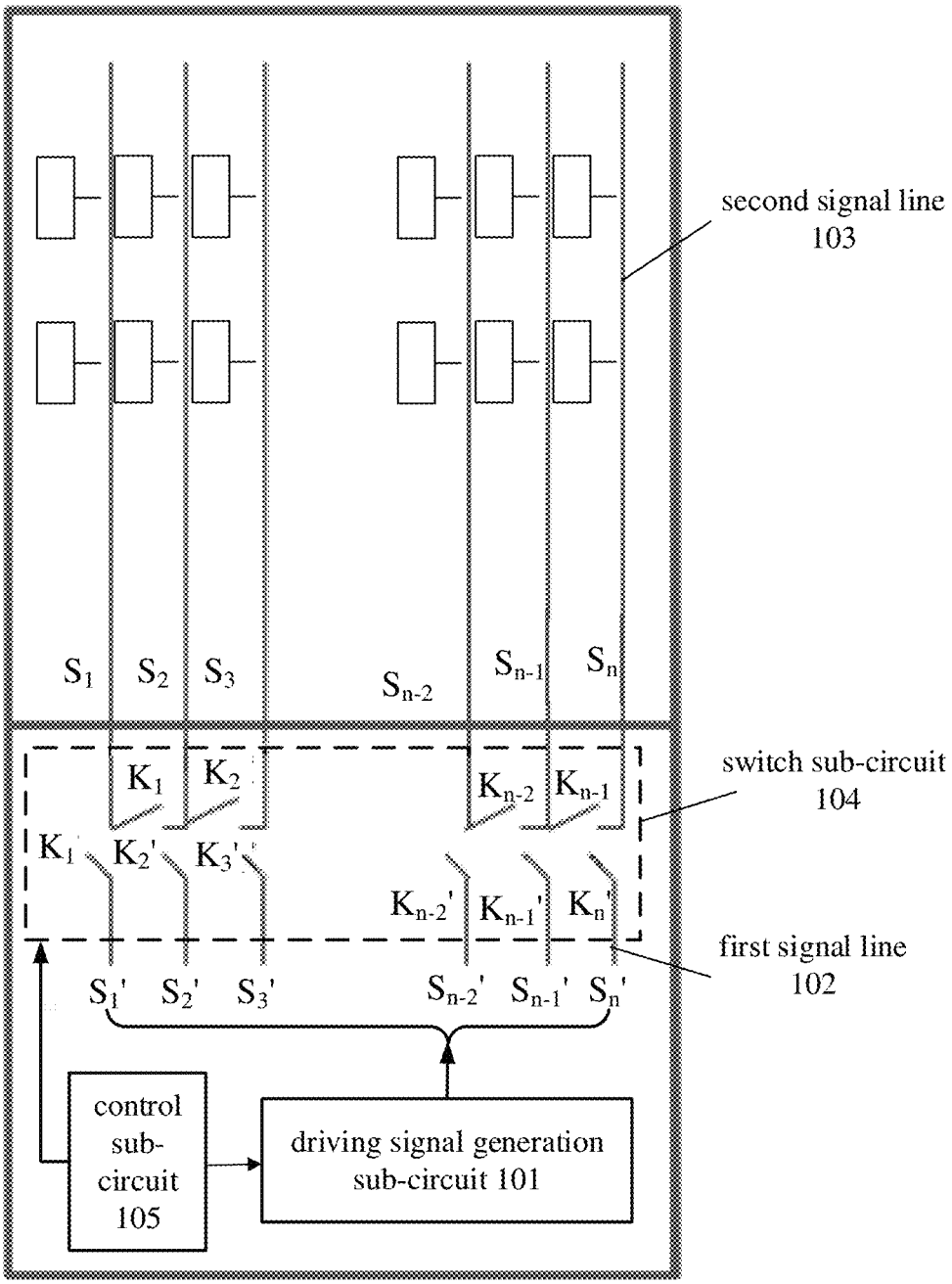
FIG. 2 is a circuit diagram illustrating a driving circuit according to some embodiments of the present disclosure.

As shown in FIG. 2, the driving circuit 100 can be for example a form of an integrated circuit. In this integrated circuit, the driving signal generation sub-circuit 101 is configured to receive an input signal which is input externally and generate a driving signal used for driving respective pixels in the display panel to display.

The plurality of first signal lines 102 are disposed at a side which is close to the driving signal generation sub-circuit inside the integrated circuit, so as to receive the driving signal generated from the driving signal generation sub-circuit 101.

The plurality of second signal lines 103 are disposed at a side close to the display panel inside the integrated circuit, so as to output the driving signal generated by the driving signal generation sub-circuit 101 to the plurality of pixels in the display panel.

Additionally, as shown in FIG. 2, each of the plurality of second signal lines 103 is used to drive one row of pixels in the display panel. The structure of such pixel circuit is well known for those skilled in the art, and thus detailed descriptions are omitted herein.

The switch sub-circuit 104 is set between the plurality of first signal lines 102 and the plurality of second signal lines 103, and configured to selectively connect a part of the plurality of second signal lines 103 or the plurality of first signal lines 102 and the plurality of second signal lines 103.

In particular, the switch sub-circuit 104 comprises a plurality of first switches $K_1$-$K_{n-1}$ and plurality of second switches $K_1'$-$K_n'$.

Each of the first switches $K_n$ is configured to selectively connect two second signal lines of the plurality of second signal lines 103.

In some embodiments, it is assumed that each switch Kn is used to connect two adjacent second signal lines 103. As shown in FIG. 2, a switch K1 is used to connect second signal lines S1 and S2, a switch K2 is used to connect second signal lines S2 and S3, . . . a switch Kn−1 is used to connect second signal lines S1 and S2.

Each second switch $K_n'$ is configured to selectively connect a first signal line and a second signal line set correspondingly.

As shown in FIG. 2, $K_1'$ is used to connect the first signal line $S_1'$ and the second signal line $S_1$, $K_2'$ is used to connect the first signal line $S_2'$ and the second signal line $S_2$, . . . , and $K_n$ is used to connect the first signal line $S_n'$ and the second signal line $S_n$.

It needs to be noted that FIG. 2 shows each of the second signal lines $S_1$-$S_n$ is connected to one column of pixels. Each pixel can comprise sub-pixels such as R, G, B or comprise sub-pixels disposed in other manners.

The driving signal transmitted from the driving signal generation sub-circuit 101 to the first signal lines $S_1'$-$S_n'$ can comprise a driving signal used for each sub-pixel. At this time, for example, by means of time-sharing driving, the driving signal used for each sub-pixel generated by the driving signal generation sub-circuit 101 is applied to a corresponding sub-pixel respectively.

Additionally, the driving circuit 100 further comprises a control sub-circuit 105 configured to control turn-on or turn-off of each switch in the switch sub-circuit 104. By controlling turn-on of each switch, the driving circuit 100 is capable of driving the plurality of pixels of the display panel in a first mode or in a second mode. For example, the first mode has the first resolution, the second mode has the second resolution, and the second resolution is lower than the first resolution.

In particular, for example, it is assumed that the first mode is a normal resolution display mode. Therefore, in the first mode, each first switch of the plurality of first switches $K_n$ is controlled to be turned off, and each second switch of the plurality of second switches $K_n'$ is controlled to be turned on.

Figure 3:
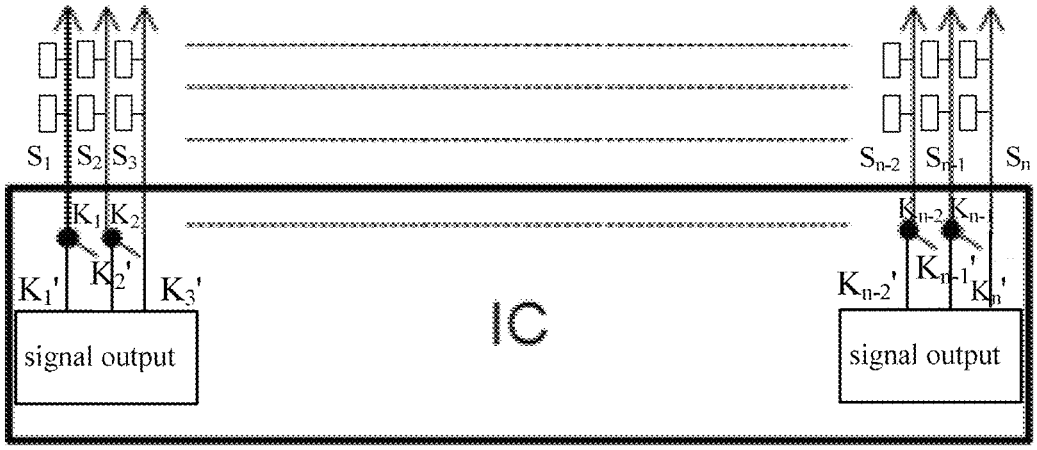
FIG. 3 is a circuit diagram illustrating a driving circuit in a first mode according to some embodiments of the present disclosure.

As shown in FIG. 3, when displaying is conducted at the normal resolution, the first switch $K_1$ is turned off, the second switch $K_1'$ is turned on, and thus the first signal line $S_1'$ and the second signal line $S_1$ are connected. In the same way, the first signal line $S_2'$ and the second signal line $S_2$ are connected, . . . , the first signal line $S_n'$ and the second signal line $S_n$ are connected. Therefore, when displaying is conducted at the normal resolution, each of the first signal lines $S_n$ and each of the second signal lines $S_n$ are connected, so that the driving signal from the driving signal generation sub-circuit 101 is transmitted to each pixel.

On the other hand, when displaying is conducted at a low resolution, a specific first switch of the plurality of first switches $K_{n-1}$ can be controlled selectively to be turned on, and a specific second switch of the plurality of second switches $K_n'$ can be controlled selectively to be turned on. It may be understood that the result of this operation can make two adjacent groups of pixels receive and display the same data, so as to display at a resolution lowering than the normal resolution.

Figure 4:
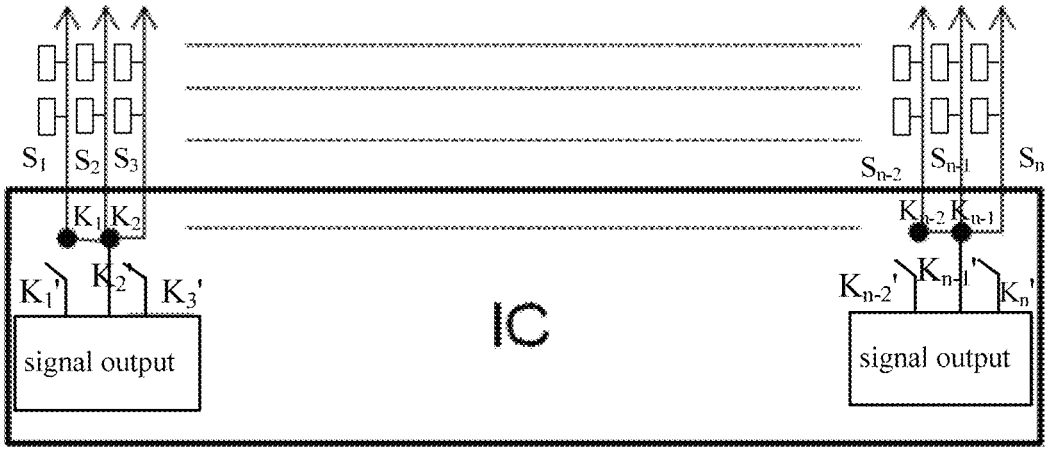
FIG. 4 is a circuit diagram illustrating a driving circuit in a second mode according to some embodiments of the present disclosure.

In particular, as shown in FIG. 4, for example, the first switches $K_1$-$K_2$ can be turned on, so that the second signal line $S_1$-$S_3$ is shorted. At the same time, the second switches $K_1'$ and $K_3'$ are turned off, and the second switch $K_2'$ is turned on. At this time, the first signal line $S_2'$ and the second signal lines $S_1$-$S_3$ are connected.

At this time, all the pixels connected to the second signal lines $S_1$-$S_3$ would display a same signal. Therefore, it can be deemed that in this area, the resolution is ⅓ of the normal resolution. That is, displaying at a low resolution is realized.

In this case, the driving signal generation portion does not need to generate a driving signal for each signal line separately, thereby greatly reducing data amount to be calculated, so that the whole power consumption is reduced.

The control sub-circuit 105 can control turn-on and turn-off of each switch in the switch sub-circuit 104, so that reduction of resolution in any desired area can be realized.

It needs to be noted that the low resolution being ⅓ of the normal resolution as described above is just an example. In fact, the control sub-circuit 105 can control turn-on and turn-off of each switch of the switch sub-circuit 104, so that displaying at any resolution in any area is realized.

For example, in an embodiment, when the user wears a virtual reality (VR) helmet, the control sub-circuit 105 can detect a point of attention of eyes of the user, displaying is conducted at a high resolution in the area corresponding to the point of attention, and displaying is conducted at a low resolution in the area beyond the point of attention.

Additionally, in another embodiment, when the driving circuit is included in the mobile terminal with a large screen, for example, when the user uses one hand to operate the mobile terminal with a large screen, an one-hand operation mode can be provided for the mobile terminal with a large screen.

In this operation mode, the control sub-circuit 105 can detect an area operated by one hand of the user. In the area operated by one hand, displaying can be conducted at a high resolution, and outside the area operated by one hand, displaying can be conducted at a low resolution.

In another embodiment, the control sub-circuit 105 is further configured to control turn-on or turn-off of the switch sub-circuit 104, so that plurality of pixels of the display panel are driven in a third mode.

Figure 5:
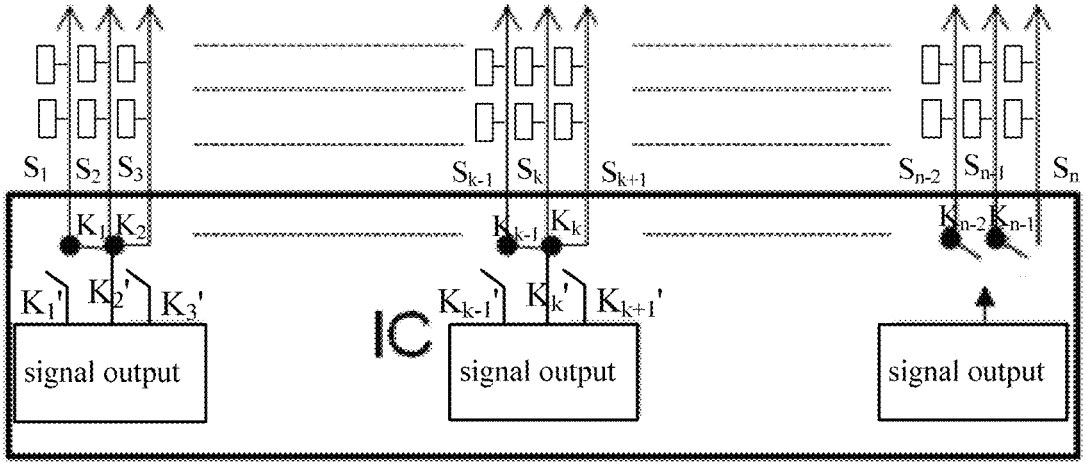
FIG. 5 is a circuit diagram illustrating a driving circuit in a third mode according to some embodiments of the present disclosure.

As shown in FIG. 5, in the third mode, in a part of area of the display panel determined according to a predetermined condition, specific switches ($K_1'$-$K_2'$) in the second switch sub-circuit are selectively controlled to be turned on. In addition, other switches ($K_{j+1}'$-$K_n'$) in the second switch sub-circuit are controlled to be turned off.

Additionally, the control sub-circuit 105 can further control the driving signal generation sub-circuit 101 to generate only a driving signal corresponding to the part of area.

That is to say, in the third mode, the driving signal can be generated only for the determined part of area of the display panel, and the pixels in the part of area are driven to display while the pixels in other parts do not need to display.

Additionally, in the third mode, like the second mode, displaying is executed at a low resolution in the specific part of area. For example, one or more of the specific switches ($K_1$-$K_3$) in the first switch sub-circuit can be controlled selectively to be turned on, so as to display at a low resolution.

In this case, the driving signal generation part needs to generate the driving signal only for the signal line in the specific area, thereby greatly reducing the data amount to be calculated, so that the entire power consumption is reduced.

In this way, by utilizing the driving circuit according to some embodiments of the present application, it is capable of switching between different resolutions to display according to different scenarios, so that the power consumption is saved.

Figure 6:
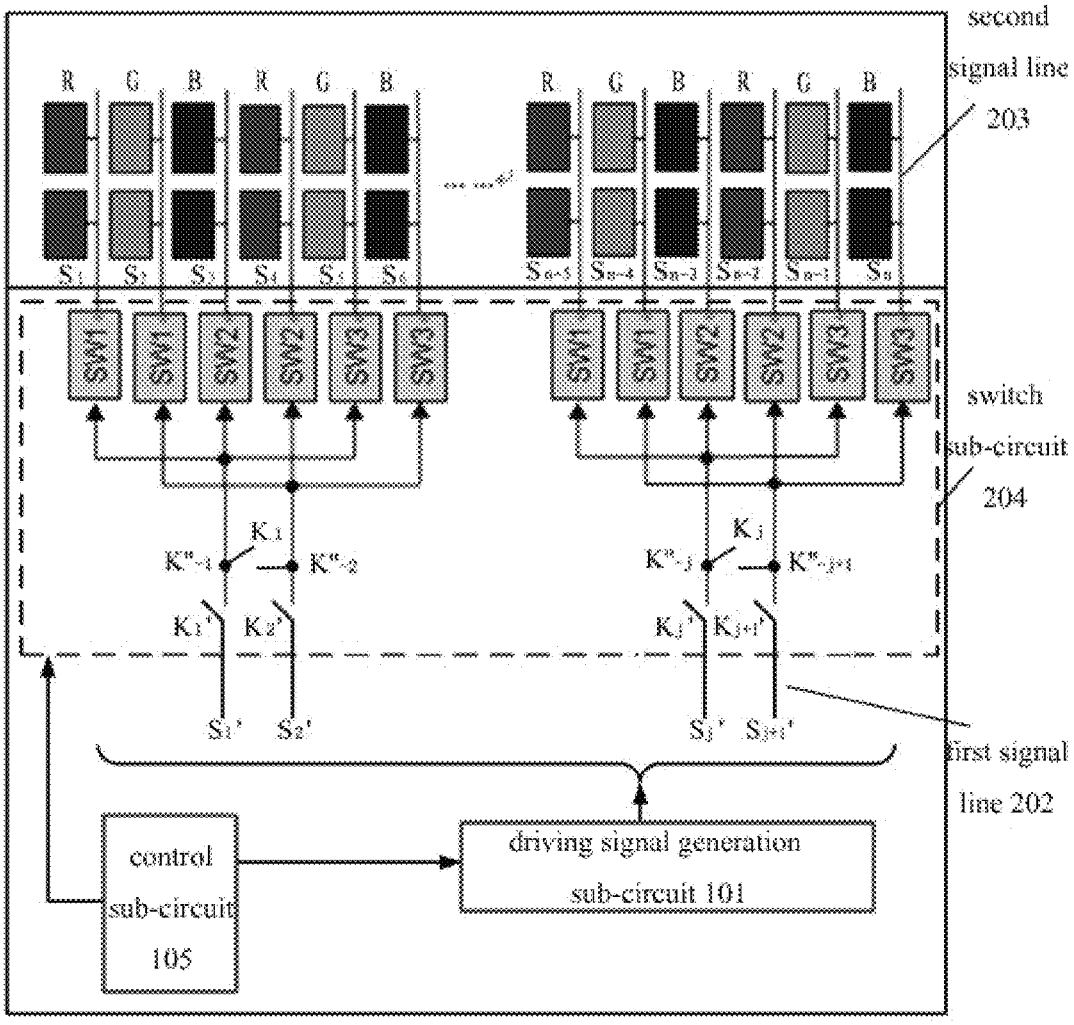
FIG. 6 is a circuit diagram illustrating a driving circuit according to some embodiments of the present disclosure.
Figure 7:
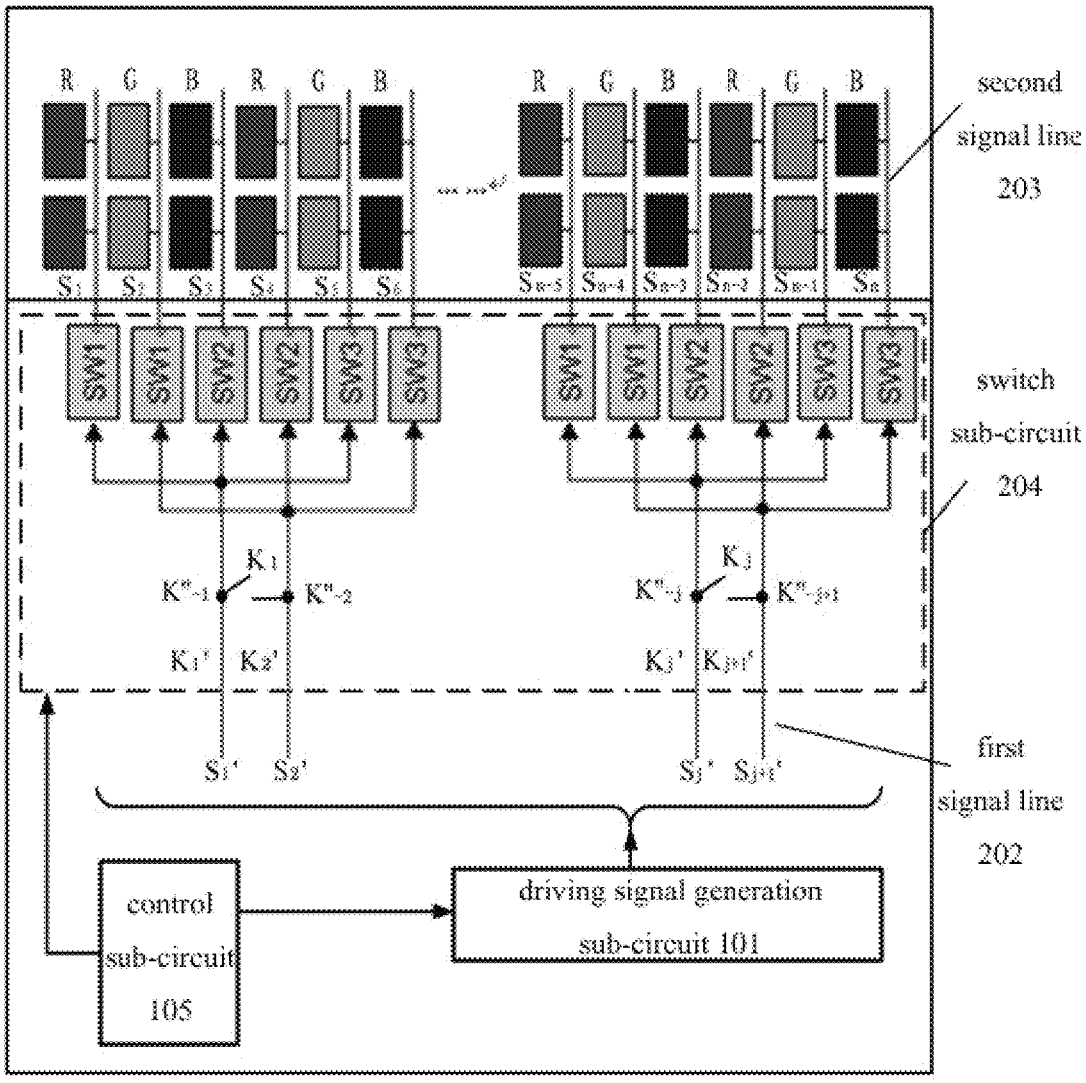
FIG. 7 is a circuit diagram illustrating a driving circuit in a first mode according to some embodiments of the present disclosure.

A driving circuit according to some embodiments of the present application will be described in detail by referring to FIGS. 6-8. FIG. 6 is a circuit diagram illustrating the driving circuit according to some embodiments of the present disclosure.

In the driving circuit 200, a plurality of first signal lines 202 are configured to receive a driving signal generated from the driving signal generation sub-circuit 101. In addition, a plurality of second signal lines 203 are configured to output the driving signal to a plurality of sub-pixels in the display panel, and the plurality of first signal lines and the plurality second signal lines are set correspondingly for example in a proportion of 1:3.

As shown in FIG. 6, in some embodiments, it is assumed that each pixel in the display panel comprises three sub-pixels, i.e., R, G, and B.

Therefore, in the driving circuit 200, it is assumed that the plurality of second signal lines 203 are disposed sequentially in a manner of R, G, and B, so as to drive the three sub-pixels R, G, and B in the display panel.

In this case, being different from the switch sub-circuit 104 described above, in some embodiments, the switch sub-circuit 204 further comprises a plurality of selection units K"–j set between the first signal line 202 and the second signal line 203. Each of the selection units K"–j includes for example three switches SW1-SW3, which are disposed respectively between three sets of the second signal line 203 and the first signal line 202. The selection units K"–j transmit selectively a driving signal from the first signal line 202 to a corresponding second signal line 203 through turn-on or turn-off of the control switches SW1-SW3 and then the driving signal is transmitted to sub-pixels to be driven.

Additionally, the switch sub-circuit 204 further comprises a first switch $K_j$, and one first switch $K_j$ is set between every two selection units $K''_{-j}$ and used to connect or disconnect the two selection units $K''_{-j}$.

Additionally, the switch sub-circuit 204 further comprises a second switch $K_j'$ configured to connect the first signal 202 and the selection units $K''_{-j}$.

In particular, as shown in FIG. 6, a selection unit $K''_{-1}$ is connected to a second signal line corresponding to the sub-pixel R in the first pixel, a second signal line corresponding to the sub-pixel B in the first pixel, and a second signal line corresponding to the sub-pixel G in the second pixel. Correspondingly, the third switch SW1 is disposed on the second signal line corresponding to the sub-pixel R in the first pixel, the third switch SW2 is disposed on the second signal line corresponding to the sub-pixel B, and the third switch SW3 is disposed on the second signal line corresponding to the sub-pixel G in the second pixel.

Also, a selection unit $K''_{-2}$ is connected to a second signal line corresponding to the sub-pixel G in the first pixel, a second signal line corresponding to the sub-pixel R in the second pixel, and a second signal line corresponding to the sub-pixel B in the second pixel. Correspondingly, the third switch SW1 is disposed on the second signal line corresponding to the sub-pixel B in the first pixel, the third switch SW2 is disposed on the second signal line corresponding to the sub-pixel B in the second pixel, and the third switch SW3 is disposed on the second signal line corresponding to the sub-pixel G in the second pixel.

At this time, for example, by adopting the mode of time-sharing driving, turn-on and turn-off of the switches SW connected to each second signal line is controlled, so as to apply the driving signal generated by the driving signal generation sub-circuit 101 to the corresponding sub-pixel.

The selection unit $K''_{-j}$ is set in this manner. Compared with the manner of connecting the adjacent three signal lines through one switch, under the condition that the driving circuit performs normal column turn-over in the process of displaying, the display panel can reduce the power consumption significantly, and flicker of the display panel is small.

In particular, the signal output of the driving signal generation sub-circuit 101 may be positive or negative. When the normal column turn-over is output, polarities of output signals on the adjacent signal lines of the driving signal generating sub-circuit 101 are opposite, and would maintain for a period of one frame. For example, during a first frame, the polarity of $S_1'$ is positive, and the polarity of $S_2'$ is negative; during a next frame, the polarity of $S_2'$ is negative, and the polarity of $S_2'$ is positive.

By taking the first frame as an example, when the selection unit is 1:3 (i.e., connecting three adjacent signal lines), the signal $S_1'$ is output to the sub-pixels R1, G1, B1 (i.e., $S_1$, $S_2$, $S_3$), and polarities of the signals are positive, and the signal $S_2'$ is output to the sub-pixels R2, G2, B2 (i.e., $S_4$, $S_5$, $S_6$), and polarities of the signals are negative. At this time, polarities of R1, G1, B1, R2, G2, B2 are: +, +, +, −, −, −; and so on and so forth, signal polarities of every three columns of sub-pixels are opposite.

At this time, in the driving process of a display panel such as a crystal liquid panel, the polarities of two adjacent signal lines are opposite, and thus when the signals on the signal line $S_1'$ are output to $S_1$, $S_2$, and $S_3$ in a time-sharing way the signal polarities on the signal line $S_1'$ would change from + into − and then change into +. At this time, a great deal of power would be consumed.

On the other hand, when the selection unit is 2:6 (i.e., for example, the selection unit is connected to three spaced signal lines in some embodiments, and controlling is conducted by taking two selection units as a group). The signal S1' is output to the sub-pixels R1, B1, G2 (i.e., S1, S3, S5), and signal polarities thereof are positive; the signal S2' is output to the sub-pixels R2, B2, G1 (i.e., S2, S4, S6), and signal polarities thereof are negative. At this time, polarities of R1, G1, B1, R2, G2, B2 are: +, −, +, −, +, − By analogy, when signal polarities of every two adjacent columns of sub-pixels are opposite, the flicker would become small.

Additionally, since the signal $S_1'$ is output to the sub-pixel R in the first pixel, the sub-pixel B in the first pixel and the sub-pixel G in the second pixel, the signal polarities of the signal $S_1'$ output to the three sub-pixels are the same. Therefore, the signal polarities of the signal line $S_1'$ are +, and at this time, very small power would be consumed, without changing the polarity.

Operations of the driving circuit according to some embodiments will be described below. As shown in FIG. 7, when displaying is conducted at the normal resolution, a first switch K1 between selection units K"−1 and K"−2 is turned off, and the second switches K1', K2' to Kj+1' are turned on. Therefore, the first signal line S1' is output to the selection unit K"−1, and then the selection unit K"−1 makes the driving signal on the first signal line S1' applied to the sub-pixel R in the first pixel, the sub-pixel G in the second pixel, and the sub-pixel B in the first pixel respectively, for example, according to the sequence of R, G and B, by controlling turn-on and turn-off of the switches SW1-SW3 (for example, according to a sequence of SW1, SW3 and SW2).

At the same time, the first signal line $S_2'$ is output to the selection unit $K''_{-2}$, and then the selection unit $K''_{-2}$ makes the driving signal on the first signal line $S_2'$ applied to the sub-pixel R in the second pixel, the sub-pixel G in the first pixel, and the sub-pixel B in the second pixel respectively, for example, according to the sequence of R, G and B, by controlling turn-on and turn-off of the switches SW1-SW3 (for example, according to a sequence of SW2, SW1 and SW3).

Therefore, when displaying is conducted at the normal resolution, each selection unit connects each of the first signal lines $S_j'$ and one of the corresponding three second signal lines $S_n$ in a time-sharing way, so that the driving signal from the driving signal generation sub-circuit 101 is transmitted to each sub-pixel.

Figure 8:
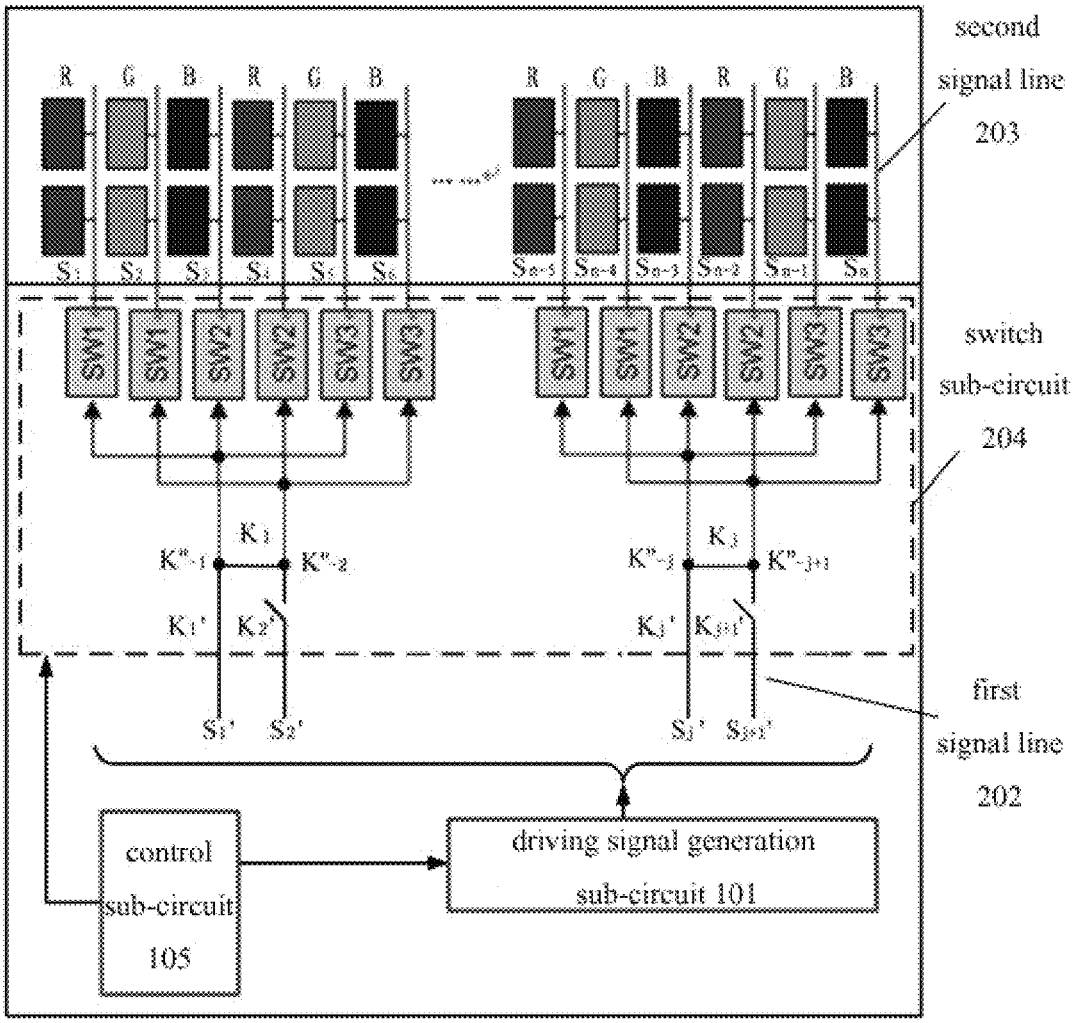
FIG. 8 is a circuit diagram illustrating a driving circuit in a second mode according to some embodiments of the present disclosure.

On the other hand, when displaying is conducted at a low resolution, as shown in FIG. 8, exemplarily, the first switch $K_1$ between the selection unit $K''_{-1}$ and $K''_{-2}$ is turned on, and the first switch $K_j$ between the selection unit $K''_{-1}$ and $K''_{-j+1}$ is turned on. At this time, the selection units $K''_{-1}$ and $K''_{-2}$ are shorted. Therefore, it needs only one of the second switches $K_1'$ and $K_2'$ to be turned on to receive the driving signal on the first signal line $S_1'$. It is assumed that the second switch $K_1'$ is turned on while $K_2'$ is turned off. At this time, the selection units $K''_{-1}$ and $K''_{-2}$ jointly receive the driving signal on the first signal line $S_1'$.

After that, by means of time-sharing driving, the turn-on and turn-off of the three switches SW1-SW3 corresponding to the selection unit $K''_{-1}$ is controlled sequentially (for example, according to the sequence of SW1, SW3 and SW2), such that the driving signals on the first signal line $S_1'$ are applied to the sub-pixel R in the first pixel, the sub-pixel G in the second pixel and the sub-pixel B in the first pixel respectively, for example, according to the sequence of R, G and B.

At the same time, by means of the time-sharing driving, the turn-on and turn-off of the three switches SW1-SW3 corresponding to the selection unit $K''_{-2}$ is controlled (for example, according to the sequence of SW2, SW1 and SW3), so that the driving signals on the first signal line S are applied to the sub-pixel R in the second pixel, the sub-pixel G in the first pixel and the sub-pixel B in the second pixel respectively, for example, according to the sequence of R, G and B.

At this time, the two adjacent groups of pixels receive and display the same signal according to the same timing sequence, i.e., the signal from the first signal line $S_1'$. Therefore, in this area, the resolution is ½ of the normal resolution, i.e., displaying at a low resolution is realized.

In this case, the driving signal generation part does not have to generate a driving signal for each signal line, thereby greatly reducing the data amount to be calculated, so that the overall power consumption is reduced.

The control sub-circuit 105 can control turn-on and turn-off of each switch in the switch sub-circuit 104, so that reduction of the resolution in any desired area is realized.

It needs to be noted that the low resolution being ½ of the normal resolution described above is just an example. In fact, the control sub-circuit 105 can control turn-on and turn-off of each switch of the switch sub-circuit 104, so that displaying at any resolution in any area is realized.

Therefore, the driving circuit according to some embodiments of the present disclosure is capable of switching between different resolutions to display according to different scenarios, so that the power consumption is saved.

The driving method according to some embodiments of the present disclosure will be described in detail by referring to FIG. 9. The driving method according to some embodiments of the present application is applicable to the driving circuit described above.

Figure 9:
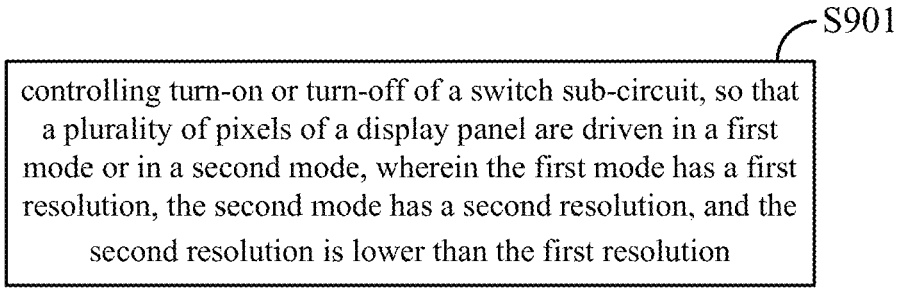
FIG. 9 is an operation flowchart illustrating a driving method according to some embodiments of the present disclosure.

FIG. 9 is a flowchart of the driving method according to some embodiments of the present disclosure. As shown in FIG. 9, the driving method 900 according to some embodiments of the present disclosure comprises:

S901: controlling turn-on or turn-off of a switch sub-circuit, so that a plurality of pixels of a display panel are driven in a first mode or in a second mode, wherein the first mode has a first resolution, the second mode has a second resolution, and the second resolution is lower than the first resolution.

In particular, in the first mode, each first switch of a plurality of first switches in the switch sub-circuit is controlled to be turned off, and each second switch of a plurality of second switches in the switch sub-circuit is controlled to be turned on.

In the second mode, a specific first switch of the plurality of first switches is controlled selectively to be turned on, and a specific second switch of the plurality of second switches is controlled to be turned on.

The driving method further comprises:

controlling turn-on or turn-off of the switch sub-circuit, so that the plurality of pixels of the display panel are driven in a third mode, wherein, in the third mode, in a part of area of the display panel determined according to a predetermined condition, the specific first switch of the plurality of first switches is controlled selectively to be turned on, and the specific switch in the second switch sub-circuit is controlled to be turned on, controlling the driving signal generation sub-circuit to generate only a driving signal corresponding to the part of area.

Specific operations of controlling the switches to be turned on or turned off has been described in the above embodiments, and thus no further detailed description is given herein.

Therefore, according to the driving method of some embodiments of the present application, different resolutions can be switched according to different scenarios to display, so that the power consumption is saved.

Figure 10:
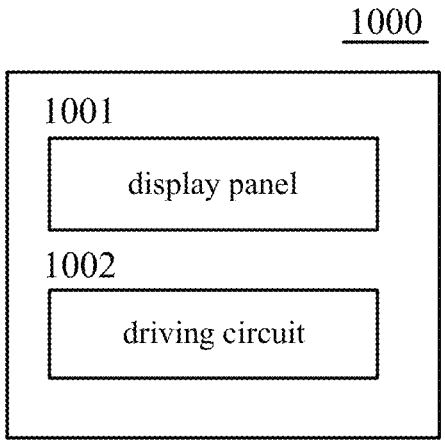
FIG. 10 is a configuration block diagram illustrating a display apparatus according to some embodiments of the present disclosure.

FIG. 10 is a configuration block diagram illustrating a display device according to some embodiments of the present disclosure. Examples of such display device can comprise a liquid crystal display, an OLED display, etc.

As shown in FIG. 10, the display device 1000 comprises:

a display panel 1001, comprising a plurality of pixels; and a driving circuit 1002, connected to the display panel 1001 to drive the display panel 1001.

The driving circuit 1002 may be any one of the driving circuits in the above embodiments.

In particular, the driving circuit 1002 comprises:

a driving signal generation sub-circuit, configured to generate a driving signal for driving a plurality of pixels in the display panel;

a plurality of first signal lines, configured to receive the driving signal generated from the driving signal generation sub-circuit;

a plurality of second signal lines, configured to output the driving signal to the plurality of pixels in the display panel;

a switch sub-circuit, set between the plurality of first signal lines and the plurality of second signal lines and configured to selectively connect a part of the plurality of second signal lines or the plurality of first signal lines and the plurality of second signal lines;

a control sub-circuit, configured to control turn-on or turn-off of the switch sub-circuit, so that the plurality of pixels of the display panel are driven in a first mode or in a second mode, wherein the display panel has a first resolution in the first mode, and the display panel has a second resolution in the second mode, and the second resolution is lower than the first resolution.

Each of the plurality of first signal lines in the driving circuit 1002 is connected to one row of pixels in the display panel 1001, so as to drive each pixel in the display panel 1001.

The switch sub-circuit comprises:

a plurality of first switches, each of which is configured to selectively connect a part of the plurality of second signal lines;

a plurality of second switches, each of which is configured to connect one of the plurality of first signal lines and one of the plurality of second signal lines corresponding thereto.

The control sub-circuit is further configured to:

in a first mode, control each first switch of the plurality of first switches to be turned off, and control each second switch of the plurality of second switches to be turned on.

The control sub-circuit is further configured to:

in a second mode, selectively control a specific first switch of the plurality of first switches to be turned on, and control a specific second switch of the plurality of second switches to be turned on.

The control sub-circuit is further configured to:

control turn-on or turn-off of the switch sub-circuit, so that the plurality of pixels of the display panel are driven in a third mode, wherein, in the third mode, in a part of area of the display panel determined according to a predetermined condition, the specific first switch of the plurality of first switches is controlled selectively to be turned on, and the specific switch of the second switch sub-circuit is controlled to be turned on, control the driving signal generation sub-circuit to generate only a driving signal corresponding to the part of area.

Therefore, the display device according to some embodiments of the present disclosure is capable of switching between different resolutions to display according to different scenarios, so that the power consumption is saved.

It needs to be noted that the above embodiments are just for illustration. The present disclosure is not limited to such illustration, but can make various alternations. The above descriptions are just exemplary implementations of the present disclosure, but are not used to limit the protection scope of the present disclosure. The protection scope of the present disclosure is subject to the claims.

It needs to specify that in the present specification, terms of "include", "comprise" or any other variants intend to cover non-exclusive containing, so that a process, a method, an object or a device comprising a series of elements not only comprise those elements, but also comprise other elements not listed explicitly, or further comprise elements inherent to this process, method, object or device. In the case of no more limitations, an element defined by an expression "comprising a . . . " does not exclude that additional same elements also exist in the process, method, object or device including the elements.

Unless otherwise defined, the technical terms or scientific terms used herein shall be of general meanings understood by those ordinary skilled in the art. Expressions of "first", "second" and other similar expressions used in the present disclosure do not indicate any sequence, number or importance, but are just used to distinguish different components. Also, "include" or "comprise" or other similar words means that an element or an object occurring prior to the word covers an element or an object and its equivalent occurring after the word, but does not exclude other elements or objects. "Connect" or "connect to" or other similar words are not limited to physical or mechanical connection, but can comprise electrical connection, regardless of direct connection or indirect connection. "Up", "down", "left", "right" and so on are just used to indicate an opposite position relationship. After an absolute position of a described object is changed, this relative position relationship is likely to be changed correspondingly.

Finally, it also needs to specify that the above series of processings not only include processes executed in a time sequence described herein, but also include processes executed in parallel or separately but not executed in a time sequence.

Through the descriptions of the above implementations, it is clear for those skilled in the art to know that the present disclosure can be realized by means of software together with necessary hardware platform, and of course can be implemented just by hardware. Based on such understanding, all or part of the technical solutions of the present disclosure that makes contribution to the background art can be reflected in a form of a software product. Thus computer software product can be stored in a storage medium, such as a read-only memory (ROM)/random-access memory (RAM), a magnetic disk, an optical disk, etc., and comprise several instructions to make one computer device (it may be a personal computer, a server, or a network device, etc.) execute the liquid crystal display panel described in the respective embodiments or some parts of the embodiments of the present disclosure.

The descriptions are detailed introduction of the present disclosure. The present disclosure applies a specific example to describe principles and implementations of the present application. The descriptions of the above embodiments are just used to help in understanding the method and its core concept of the present disclosure; at the same time, for those ordinary skilled in the art, some alternations can be made within the specific implementations and applications based on the concept of the present disclosure. To sum up, the content of the present disclosure shall not be understood as a limitation to the present application.

What is claimed is:

1. A driving circuit, comprising:

a driving signal generation sub-circuit, configured to generate a driving signal for driving a plurality of pixels in a display panel;

a plurality of first signal lines, configured to receive the driving signal generated from the driving signal generation sub-circuit;

a plurality of second signal lines, configured to output the driving signal to the plurality of pixels in the display panel;

a switch sub-circuit, set between the plurality of first signal lines and the plurality of second signal lines, and configured to selectively connect a part of the plurality of second signal lines or the plurality of first signal lines and the plurality of second signal lines; and a control sub-circuit, configured to control turn-on or turn-off of the switch sub-circuit, so that the plurality of pixels of the display panel are driven in a first mode or in a second mode, wherein the display panel has a first resolution in the first mode, and the display panel has a second resolution in the second mode, and the second resolution is lower than the first resolution, wherein the switch sub-circuit comprises a plurality of selection units, one end of each selection unit is connected to a corresponding first signal line and the other end is connected to a plurality of second signal lines, and each selection unit comprises a plurality of switches which correspond to the plurality of second signal lines one by one, and the plurality of switches are controlled to be turned on or off in a time-sharing driving way to selectively transmit driving signals from the corresponding first signal line to the corresponding second signal lines.

2. The driving circuit according to claim 1, wherein the switch sub-circuit comprises:

a plurality of first switches, each first switch is configured to selectively connect a part of the plurality of selection units; and a plurality of second switches, each of the plurality of second switches is able to connect the plurality of first signal lines and the plurality of selection units which are set correspondingly.

3. The driving circuit according to claim 2, wherein the control sub-circuit is further configured to:

in the first mode, control each first switch of the plurality of first switches to be turned off, and control each second switch of the plurality of second switches to be turned on.

4. The driving circuit according to claim 2, wherein the control sub-circuit is further configured to:

in the second mode, selectively control a specific first switch of the plurality of first switches to be turned on, and control a specific second switch of the plurality of second switches to be turned on.

5. The driving circuit according to claim 2, wherein the control sub-circuit is further configured to:

control turn-on or turn-off of the plurality of first switches and the plurality of second switches, so that the plurality of pixels of the display panel are driven in a third mode, wherein, in the third mode, in a part of an area of the display panel determined according to a predetermined condition, a specific first switch of the plurality of first switches is controlled selectively to be turned on, and a specific second switch of the plurality of second switches is controlled to be turned on; and control the driving signal generation sub-circuit to generate only a driving signal corresponding to the part of the area.

6. A driving method applicable to the driving circuit according to claim 1, the method comprising:

driving the plurality of pixels of the display panel under the first mode or the second mode by controlling a connection state of a plurality of first switches and a plurality of second switches in the switch sub-circuit, wherein the connection state of the plurality of first switches and the plurality of second switches in the switch sub-circuit comprises turn-on and turn-off of the plurality of first switches and the plurality of second switches in the switch sub-circuit.

7. The driving method according to claim 6, wherein in the first mode, each first switch of a plurality of first switches in the switch sub-circuit is controlled to be turned off, and each second switch of a plurality of second switches in the switch sub-circuit is controlled to be turned on.

8. The driving method according to claim 6, wherein in the second mode, a specific first switch of the plurality of first switches in the switch sub-circuit is controlled selectively to be turned on, and a specific second switch of the plurality of second switches in the switch sub-circuit is controlled to be turned on.

9. The driving method according to claim 6, further comprising:

driving the plurality of pixels of the display panel under a third mode by controlling the connection state of the plurality of first switches and the plurality of second switches in the switch sub-circuit, wherein, in the third mode, in a part of an area of the display panel determined according to a predetermined condition, a specific first switch of the plurality of first switches is controlled selectively to be turned on, and a specific second switch in the switch sub-circuit is controlled to be turned on; and generating a driving signal only corresponding to the part of the area by the driving signal generation sub-circuit.

10. A display apparatus, comprising:

a display panel, including a plurality of pixels; and a driving signal generation sub-circuit, configured to generate a driving signal for driving the plurality of pixels in the display panel;

a plurality of first signal lines, configured to receive the driving signal generated from the driving signal generation sub-circuit;

a plurality of second signal lines, configured to output the driving signal to the plurality of pixels in the display panel;

a switch sub-circuit, set between the plurality of first signal lines and the plurality of second signal lines, and configured to selectively connect a part of the plurality of second signal lines or the plurality of first signal lines and the plurality of second signal lines; and a control sub-circuit, configured to control turn-on or turn-off of the switch sub-circuit, so that the plurality of pixels of the display panel are driven in a first mode or in a second mode, wherein the display panel has a first resolution in the first mode, and the display panel has a second resolution in the second mode, the second resolution is lower than the first resolution, wherein the switch sub-circuit comprises a plurality of selection units, one end of each selection unit is connected to a corresponding first signal line and the other end is connected to a plurality of second signal lines, and each selection unit comprises a plurality of switches which correspond to the plurality of second signal lines one by one, and the plurality of switches are controlled to be turned on or off in a time-sharing driving way to selectively transmit driving signals from the corresponding first signal line to the corresponding second signal lines.

11. The display apparatus according to claim 10, wherein the switch sub-circuit comprises:

a plurality of first switches, each first switch is configured to selectively connect a part of the plurality of selection units; and a plurality of second switches, each of the plurality of second switches is able to connect the plurality of first signal lines and the plurality of selection units which are set correspondingly.

12. The display apparatus according to claim 11, wherein the control sub-circuit is further configured to:

in the first mode, control each first switch of the plurality of first switches to be turned off, and control each second switch of the plurality of second switches to be turned on.

13. The display apparatus according to claim 12, wherein the control sub-circuit is further configured to:

in the second mode, selectively control a specific first switch of the plurality of first switches to be turned on, and control a specific second switch of the plurality of second switches to be turned on.

14. The display apparatus according to claim 11, wherein the control sub-circuit is further configured to:

control turn-on or turn-off of the plurality of first switches and the plurality of second switches in the switch sub-circuit, so that the plurality of pixels of the display panel are driven in a third mode, wherein, in the third mode, in a part of an area of the display panel determined according to a predetermined condition, a specific first switch of the plurality of first switches is controlled selectively to be turned on, and a specific second switch of the plurality of second switches is controlled to be turned on; and generate a driving signal only corresponding to the part of the area by the driving signal generation sub-circuit.

* * * * *